US011499356B2

(12) United States Patent
Dey

(10) Patent No.: US 11,499,356 B2
(45) Date of Patent: Nov. 15, 2022

(54) VEHICLE WINDOW REGULATOR WITH WINDOW PROTECTION SYSTEM

(71) Applicant: Nissan North America, Inc., Franklin, TN (US)

(72) Inventor: Debraj Dey, Novi, MI (US)

(73) Assignee: Nissan North America, Inc., Franklin, TN (US)

( * ) Notice: Subject to any disclaimer, the term of this patent is extended or adjusted under 35 U.S.C. 154(b) by 83 days.

(21) Appl. No.: 17/162,668

(22) Filed: Jan. 29, 2021

(65) Prior Publication Data

US 2022/0243514 A1 Aug. 4, 2022

(51) Int. Cl.
*E05F 11/48* (2006.01)
*E05F 11/38* (2006.01)

(52) U.S. Cl.
CPC ..... *E05F 11/382* (2013.01); *E05Y 2201/684* (2013.01); *E05Y 2900/55* (2013.01)

(58) Field of Classification Search
CPC ..... E05F 11/382; E05Y 2201/684; E05Y 2900/55
USPC ..... 49/352, 375
See application file for complete search history.

(56) References Cited

U.S. PATENT DOCUMENTS 4,335,541 A * 6/1982 Kazewych ..... E05F 11/426 49/352
4,442,632 A * 4/1984 Greco ..... E05F 11/485 49/352
4,925,511 A 5/1990 Ikeda et al.
5,009,035 A * 4/1991 Kuki ..... E05F 11/486 49/374
5,515,651 A 5/1996 Hofmann et al.
5,809,695 A * 9/1998 Strickland ..... E05F 11/488 49/352
5,864,987 A * 2/1999 Mariel ..... E05F 11/385 49/352
6,874,279 B1 * 4/2005 Weber ..... E05F 11/488 49/459
7,076,918 B2 * 7/2006 Tatsumi ..... B60J 5/0416 49/374
7,802,401 B2 * 9/2010 Wild ..... E05F 11/382 49/352

(Continued)

FOREIGN PATENT DOCUMENTS

CN 108894651 A * 11/2018 ..... E05F 15/689
DE 102012208562 A1 11/2013
DE 112017006478 T5 * 9/2019 ..... B60J 1/17

*Primary Examiner* — Jerry E Redman
(74) *Attorney, Agent, or Firm* — Young Basile Hanlon & MacFarlane, P.C.

(57) ABSTRACT

A window regulator comprises: a carrier plate having a front surface and a rear surface, the carrier plate configured to be attached to a guide rail with the rear surface facing the guide rail; a first lifter attachment portion spaced from a second lifter attachment portion, the first lifter attachment portion and the second lifter attachment portion integral with the carrier plate and each having a lifter aperture configured to receive a window lifter; a flange extending at an angle along a length of an edge of the front surface of the carrier plate; and a window protection system proximate to the first lifter attachment portion and the second lifter attachment portion. At least a part of the window protection system is configured to extend beyond a distal edge of the flange in a front-facing direction.

20 Claims, 12 Drawing Sheets

(56) References Cited

U.S. PATENT DOCUMENTS

| | | | | |
|---|---|---|---|---|
| 8,826,595 | B2 * | 9/2014 | Nakamura | E05F 11/426 49/350 |
| 2007/0006533 | A1 | 1/2007 | Dedrich et al. | |
| 2008/0236049 | A1 * | 10/2008 | Arimoto | E05F 11/483 49/352 |
| 2011/0010999 | A1 * | 1/2011 | Broadhead | E05F 11/483 49/352 |
| 2017/0241181 | A1 * | 8/2017 | Reinke | E05F 11/385 |

* cited by examiner

VEHICLE WINDOW REGULATOR WITH WINDOW PROTECTION SYSTEM

TECHNICAL FIELD

This disclosure relates to window regulators for vehicles having a window protection system, such as bumpers, to prevent scratching during installation.

BACKGROUND

The installation of certain windows in vehicle doors requires that the window glass be positioned at the bottom of the door and fed into window channels via the top corners of the window. After the window seal is installed in the window opening, the window is moved up the channels and into the window seal until positioned on the window regulator and in its installed shipping position. The window must move over the window regulator until the installed shipping position is reached. Due to limited clearance between the window regulator and door support members, the window can be scratched as it is moved up the door, into the window seals, and fixed in the installed shipping position.

SUMMARY

Disclosed herein are implementations of window regulators for vehicle door windows having a window protection system. One implementation of a window regulator comprises: a carrier plate having a front surface and a rear surface, the carrier plate configured to be attached to a guide rail with the rear surface facing the guide rail; a first lifter attachment portion spaced from a second lifter attachment portion, the first lifter attachment portion and the second lifter attachment portion integral with the carrier plate and each having a lifter aperture configured to receive a window lifter; a flange extending at an angle along a length of an edge of the front surface of the carrier plate; and a window protection system proximate to the first lifter attachment portion and the second lifter attachment portion. At least a part of the window protection system is configured to extend beyond a distal edge of the flange in a front-facing direction.

Another implementation of a window regulator for a vehicle door window comprises: a carrier plate having a front surface and a rear surface, the carrier plate configured to be attached to a guide rail with the rear surface facing the guide rail; a first lifter attachment portion spaced from a second lifter attachment portion, the first lifter attachment portion and the second lifter attachment portion integral with the carrier plate and each having a lifter aperture configured to receive a window lifter; a flange extending at an angle along a length of an edge of the front surface of the carrier plate, the flange having a distal edge; a first bumper extending from a front flat surface of the first lifter attachment portion; and a second bumper extending from a front flat surface of the second lifter attachment portion, wherein the first bumper extends beyond the distal edge of the flange.

Other implementations of a window regulator for a vehicle door window are disclosed herein. Also disclosed herein is a vehicle door comprising: a window regulator having a first surface and a second surface opposite the first surface; and a guide rail, wherein the window regulator is movably attached to the guide rail with the second surface facing the guide rail, the window regulator configured to attach to a window and move the window via movement of the window regulator along the guide rail. The window regulator comprises: a first lifter attachment portion spaced from a second lifter attachment portion, the first lifter attachment portion and the second lifter attachment portion each having a lifter aperture configured to receive a window lifter; a flange extending at an angle along an edge of the window regulator in a direction opposite the guide rail; and a window protection system proximate to the first lifter attachment portion and the second lifter attachment portion, at least a part of which is configured to extend beyond a distal edge of the flange in the direction opposite the guide rail.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
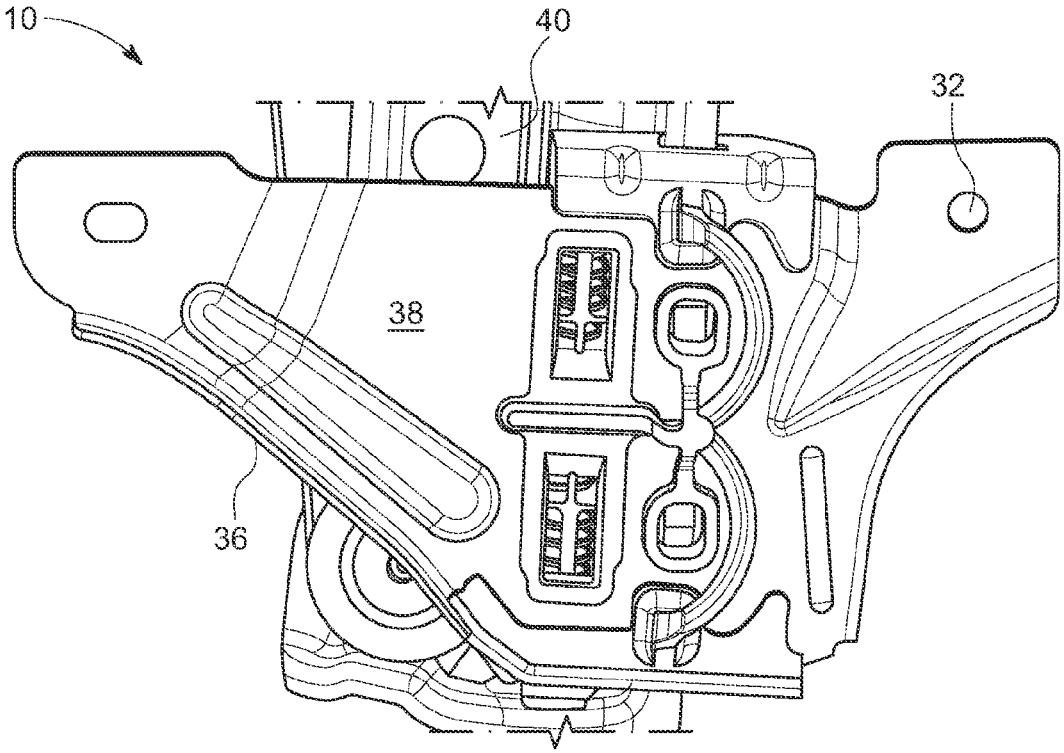
FIG. 1 Prior Art
FIG. 1 is a schematic of a conventional window regulator attached to a guide rail.
Figure 2A:
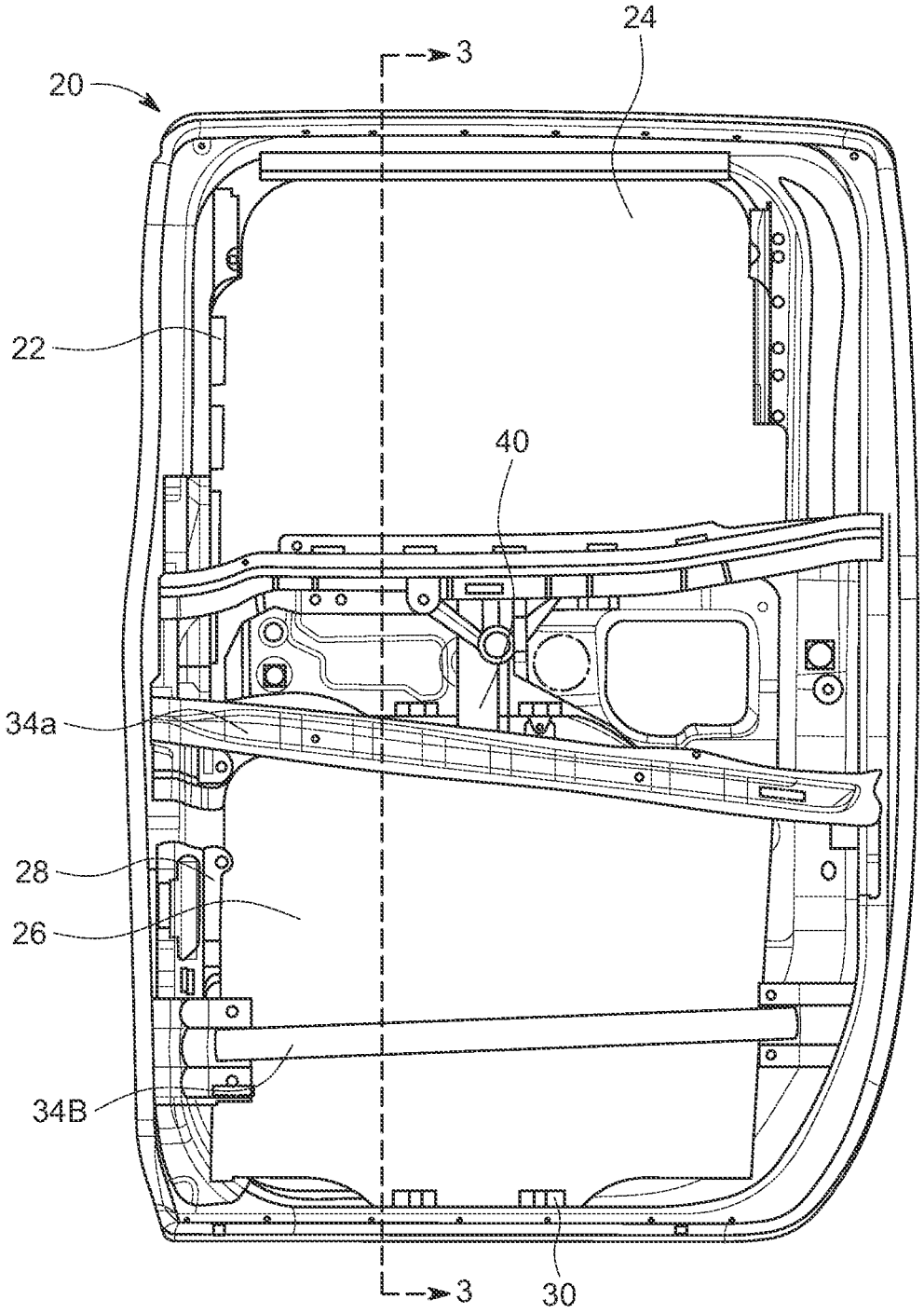
FIG. 2A is a schematic of a vehicle door with the outer door panel removed, the window initially positioned in window channels for installation.
Figure 2B:
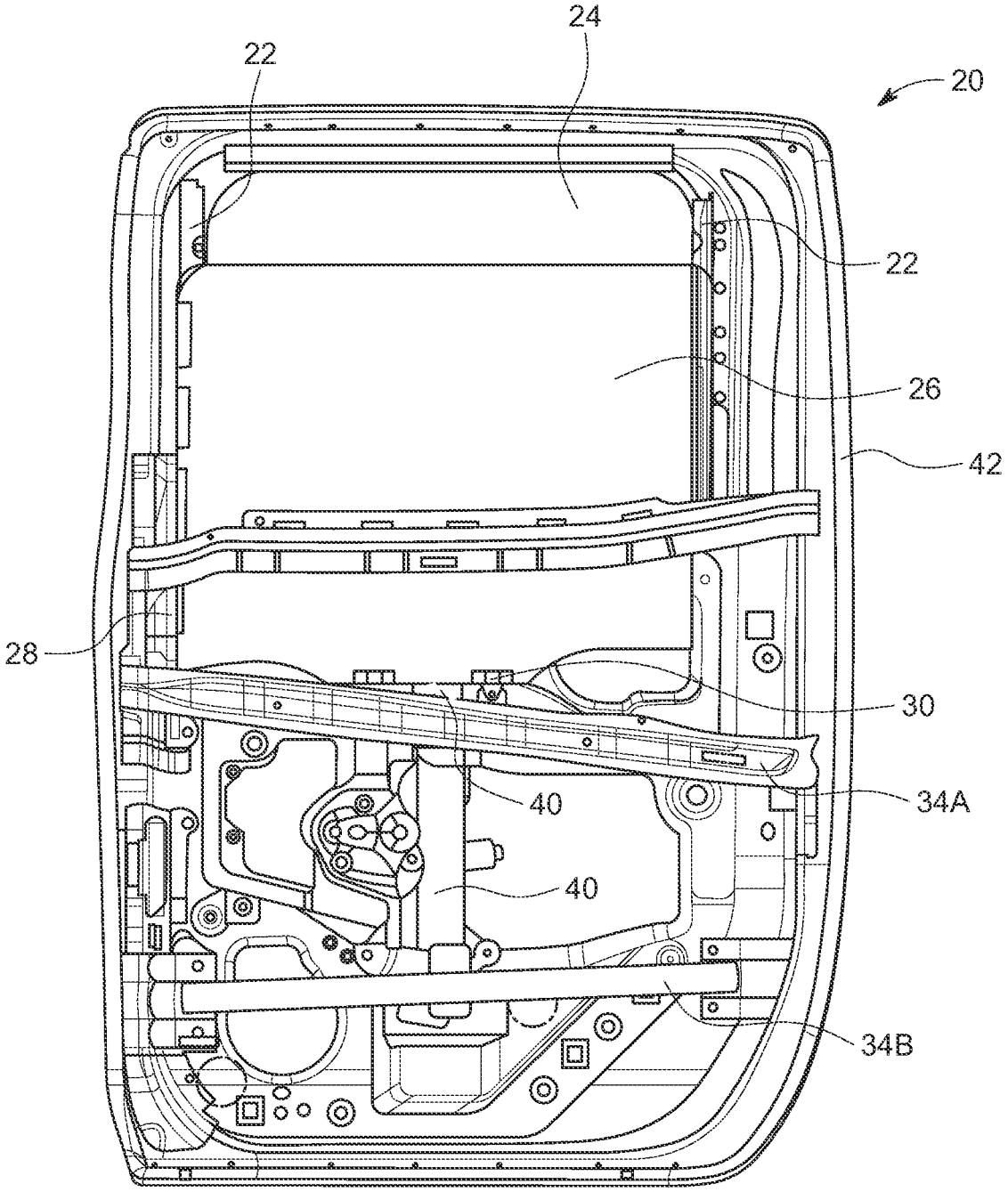
FIG. 2B is the schematic of the vehicle door of FIG. 2A with the window in the installed shipping position.

The window regulator is the device that moves the window, also referred to as glass, up and down in a vehicle and is used with both power windows and manually operated windows. FIG. 1 shows a conventional window regulator 10. The installation of certain windows in vehicle doors requires an installer to work the window up through a door with the door panels already assembled. For each of description, the outer door panel is removed in FIGS. 2A and 2B, exposing the internals of the door 20 to assist in the description. The window seals 22 are installed around the window opening 24. The window 26 is positioned at the bottom of the door 20 as shown in FIG. 2A and fed into window channels 28 via the top corners 30 of the window 26. The window 26 is then moved up the window channels 28 and into the window seals 22 until positioned on the window regulator 10, which is in a fixed position within the door 20. The window 26 is correctly positioned on the window regulator 20 when lifters 30 on the window 26 pop into the lifter openings 32 within the window regulator 20, as shown in FIG. 2B. The window regulator 20 is illustrated in its shipping position, such that the window 26 is positioned in the window seals 22 along the side of the window 26 but is not completely within the window opening 24.

This vehicle window installation process can be used to install any type of door window, whether on the front door or back door, and with any shape of window. Conventionally, this vehicle window installation process was developed for use with substantially square or rectangular shaped windows, which require alignment with the window seals prior to any portion of the window being fitted into a window seal.

Figure 3:
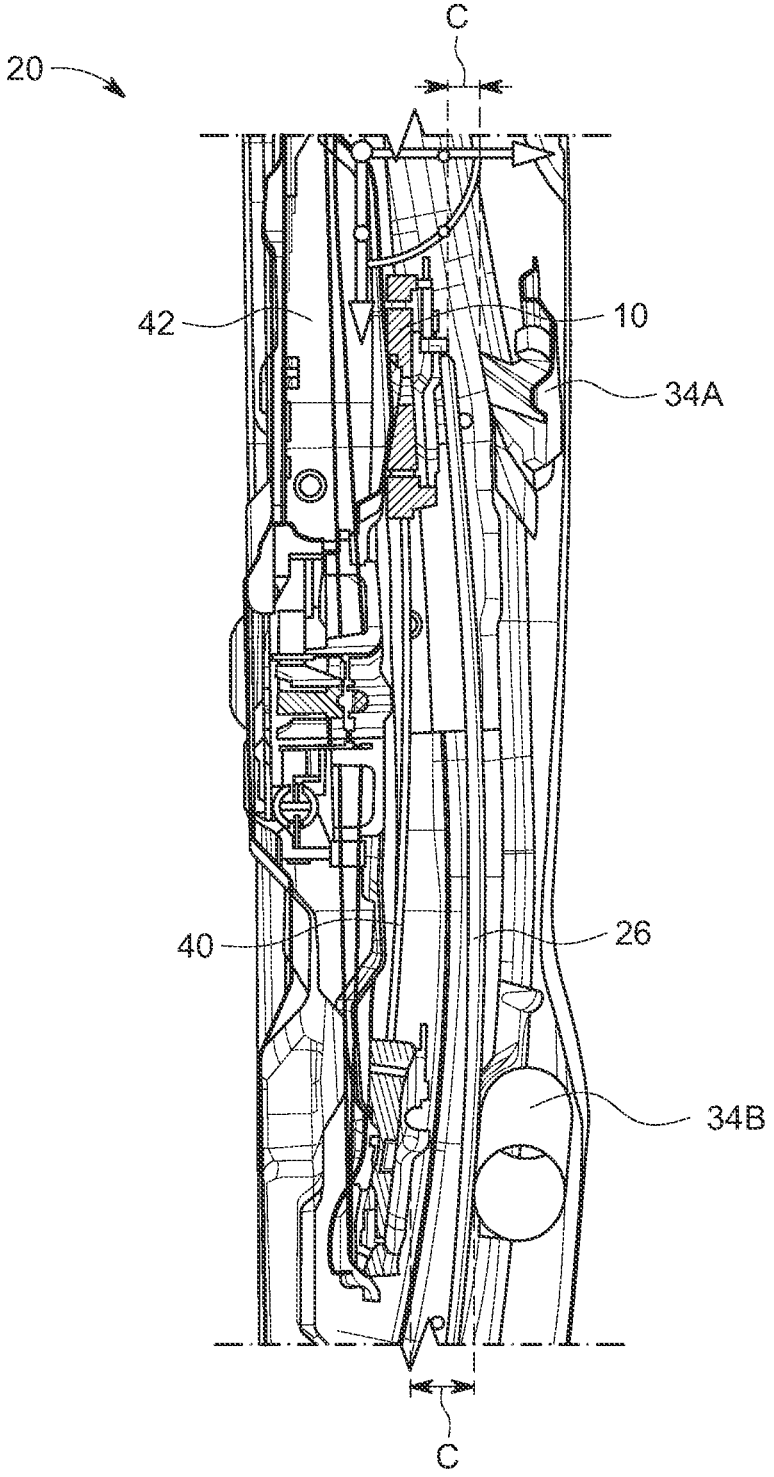
FIG. 3 is an enlarged portion of a cross section of FIG. 2A along line 3.

This vehicle window installation process can result in the window being scratched by the window regulator when the window is pulled up to its shipping position due to the tight clearance within which to move the window. FIG. 3 illustrates the clearance available within which the window can be moved. Clearance C is limited by the window regulator 10 and the frame supports 34A, 34B that extend across the door 20. In particular, clearance C is limited by the flange 36 extending from the face 38 of the window regulator 10 and frame support 34A, and by the guide rail 40 for the window regulator 10 and frame support 34B. As illustrated in FIGS. 2A, 2B and 3, the window regulator 10 in the shipping position is between the inner door panel 42 and the frame support 34A when viewing the door 20 in a vertical position with the outer door panel removed.

To avoid scratching the window, a window regulator formed without the flange was attempted. However, the window regulator lacked the requisite strength to support and move the window without the flange 36.

Figure 4:
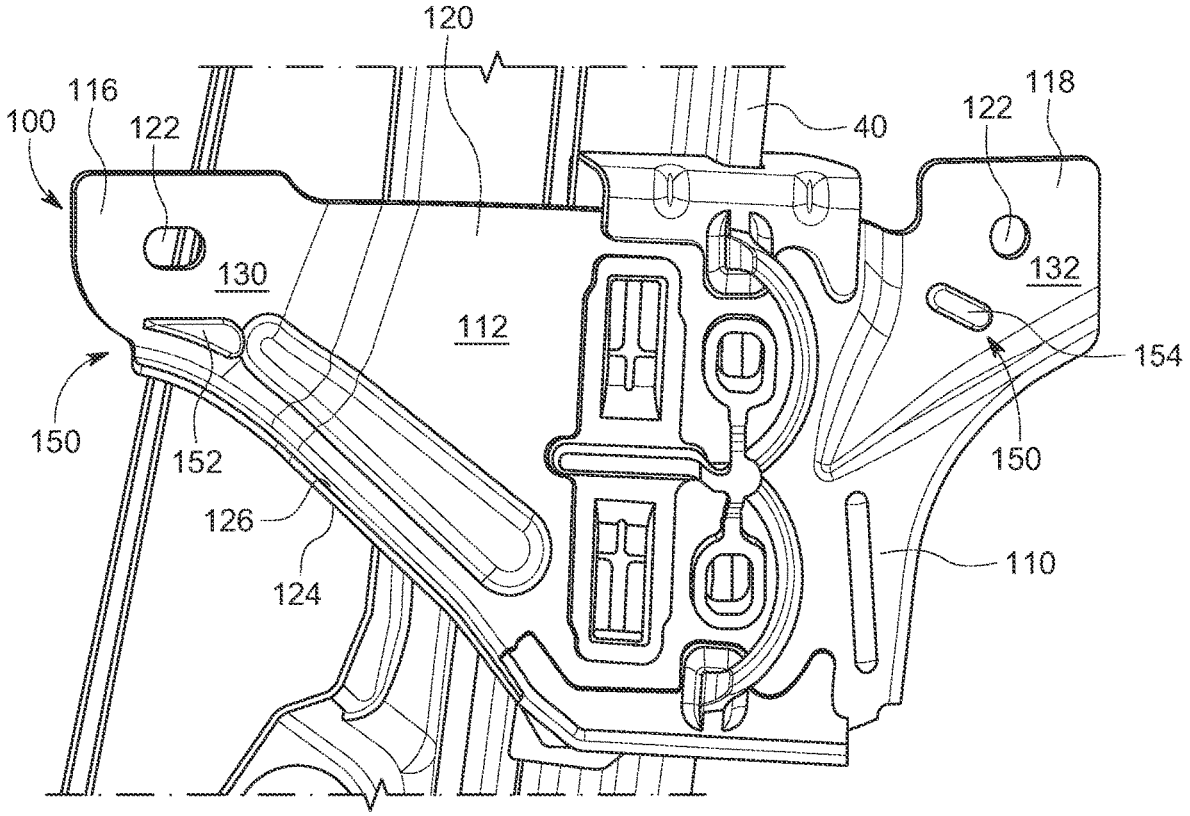
FIG. 4 is a front elevation view of an implementation of a window regulator attached to a guide rail as disclosed herein.
Figure 5:
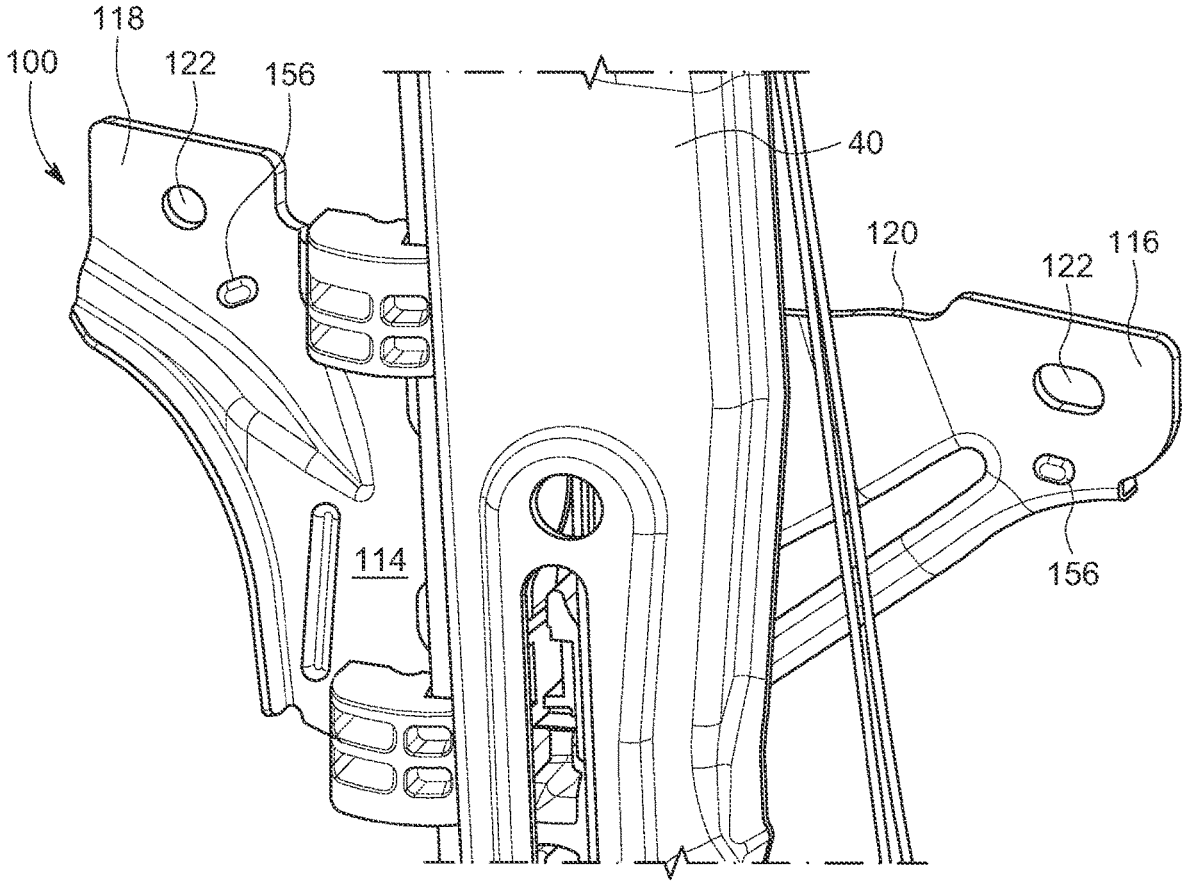
FIG. 5 is a rear elevation view of the window regulator attached to the guide rail of FIG. 4.

Disclosed herein are implementations of a vehicle window regulator with bumpers that prevent scratching of the window during installation. The implementations are described with respect to FIGS. 4, 9 and 10, and shared elements across the implementations are referred to with the same reference numbers.

The window regulator 100 (FIG. 4), 200 (FIG. 9), 300 (FIG. 10) for a vehicle door window 26 comprises a carrier plate 110 having a front surface 112 and a rear surface 114, the carrier plate 110 configured to be attached to a guide rail 40 with the rear surface 114 facing the guide rail 40. The guide rail 40 is also illustrated in FIGS. 2A, 2B and 3. The window regulator 100, 200, 300 moves along the guide rail 40 to move the window 26 up and down in response to a user depressing a power window actuator or turning a manual window actuator. A first lifter attachment portion 116 is spaced from a second lifter attachment portion 118 and both are integral with the carrier plate 110. The shape of the carrier plate 110 may differ from the carrier plate 110 illustrated in the figures, but generally will have the first lifter attachment portion 116 and the second lifter attachment portion 118 positioned along a top edge 120 of the carrier plate 110 in an installed position and spaced apart along the top edge to sufficiently support the window 26 when attached to the carrier plate 110. The window regulator can have one or more additional lifter attachment portions. In such an embodiment, the first and second lifter attachment portions 116, 118 refer to the outermost lifter attachment portions.

Figure 6:
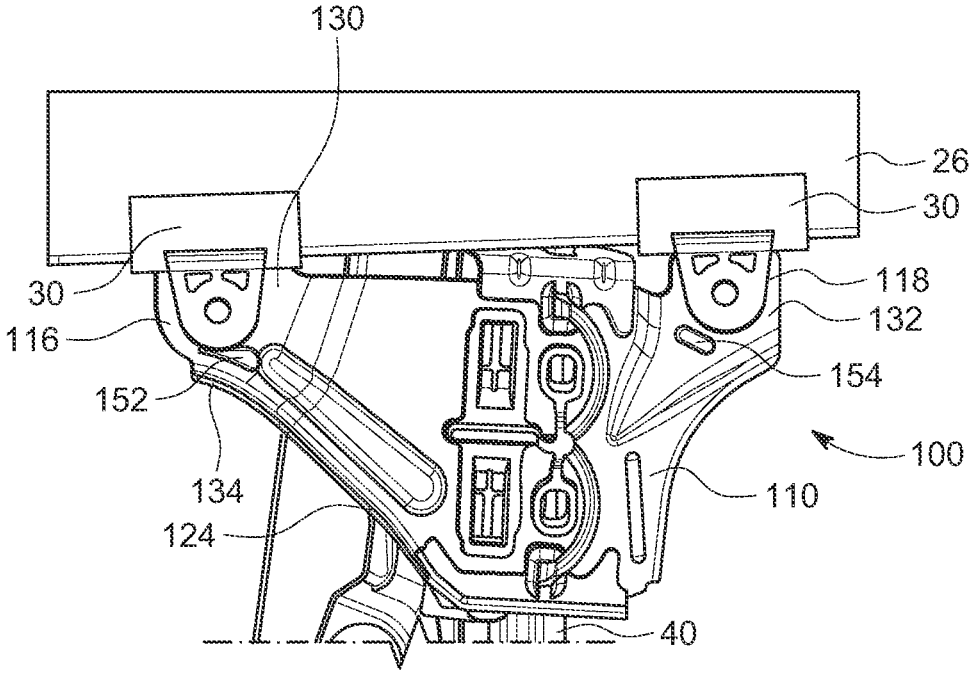
FIG. 6 is the front elevation view of the window regulator attached to a guide rail as shown in FIG. 4 with a window attached to the window regulator via window lifters.

Each of the first and second lifter attachment portions 116, 118 has a lifter aperture 122 configured to receive a window lifter 30. As illustrated in FIG. 6, the window lifter 30 can be configured as two window lifters that hold the window 26 and attach to respective first and second lifter attachment portions 116, 118 via lifter apertures 122. The window lifter 30 can be configured to be multiple lifters corresponding to the number of lifter attachment portions. Alternatively, the window lifter 30 can be a single window lifter with respective places to attach to the lifter attachment portions. The window lifter 30 can also be integral with the window 26, e.g., a portion of the glass, that attached directly to the lifter attachment portions 116, 118. Other configurations of window lifters known to those skilled in the art are contemplated.

The window regulator 100, 200, 300 further has a flange 124 extending at an angle along a length of an edge 126 of the front surface 112 of the carrier plate 110. The flange 124 extends outwards in a front-facing direction F, illustrated in FIG. 7, which from the inner door panel 42 to the outer door panel (not shown). The flange 124, or a portion thereof, is the part of the carrier plate 110 that extends furthest in the front-facing direction F and limits the clearance C between the carrier plate 110 and the frame support 34A described with respect to FIG. 3.

The window regulator 100, 200, 300 further has a window protection system 150 (FIG. 4), 250 (FIG. 9), 350 (FIG. 10) proximate to the first lifter attachment portion 116 and the second lifter attachment portion 118. At least a part of the window protection system 150, 250, 350 is configured to extend beyond a distal edge 128 of the flange 124 in the front-facing direction F.

FIGS. 4-8 illustrate an implementation of the window regulator 100 window protection system 150. Window protection system 150 comprises a first bumper 152 extending from a front flat surface 130 of the first lifter attachment portion 116 and a second bumper 154 extending from a front flat surface 132 of the second lifter attachment portion 118. The first and second lifter attachment portions 116, 118 have front flat surfaces 130, 132 to securely attach to the window lifter 30 and position the window 26 in a planar position aligned with the window seals 22 and window channel 28 so that the window can move up and down in a vertical direction. The first and second lifter attachment portions 116, 118 have non-planar surfaces that position the front flat surfaces 130, 132 in a different plane than the front surface 112 of the carrier plate 110 to provide clearance between the window 26 and the guide rail 40.

Figure 7:
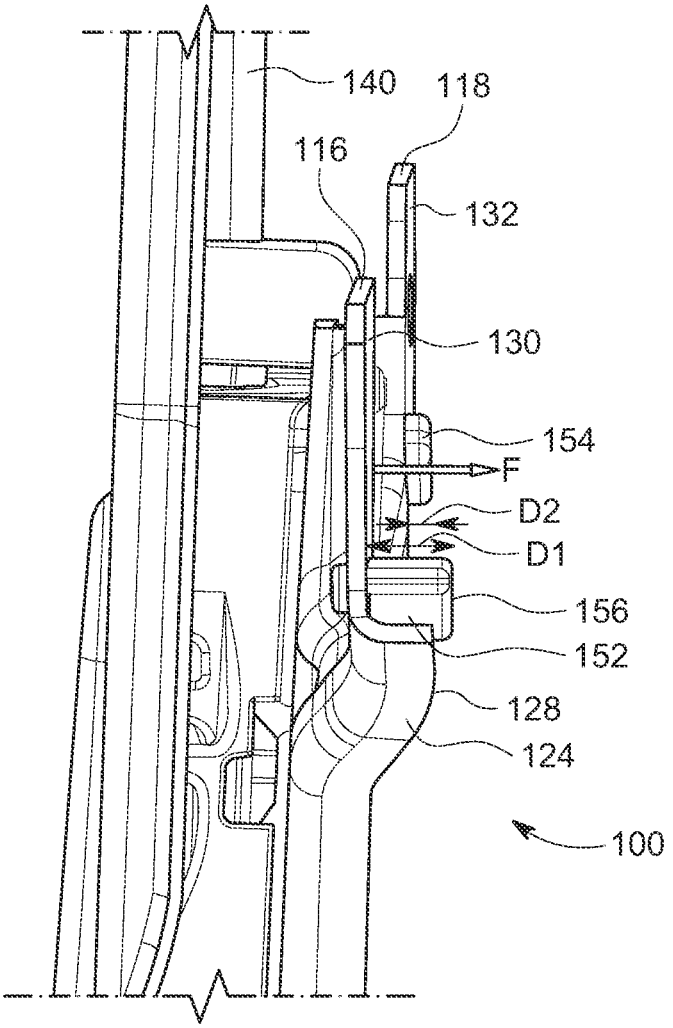
FIG. 7 is an enlarged left side view of the window regulator attached to the guide rail in FIG. 4.
Figure 8:
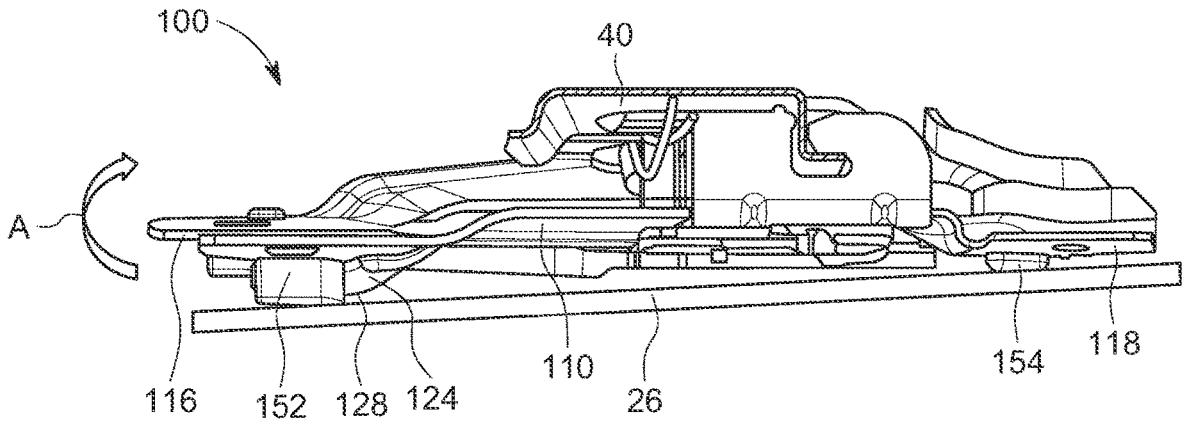
FIG. 8 is a top plan view of the window regulator attached to the guide rail in FIG. 4 with a window in contact with the window regulator in an intermediate position of installation.

The first bumper 152 and the second bumper 154 are injection molded plastic, such as polyoxymethylene (POM) as a non-limiting example, each molded in a respective bumper aperture 156 in each of the first lifter attachment portion 116 and the second lifter attachment portion 118, best seen in FIG. 6, which views the window regulator 100 from the rear surface 114 attached to the guide rail 40. The first bumper 152 extends beyond the distal edge 128 of the flange 124, as illustrated in FIGS. 7 and 8, in the front-facing direction F. In such a configuration, the first bumper 152 is positioned to contact the window 26 as the window 26 is installed along the window channels 28 between the window regulator 100 and the door frame supports 34A, 34B. The first bumper 152 will not scratch the window 26 when in contact with the window 26.

The first bumper 152 has a first depth D1 measured from the front flat surface 130 of the first lifter attachment portion 116 to a distal end 156 of the first bumper 152 in the front-facing direction F, illustrated in FIGS. 7 and 8. The second bumper 154 has a second depth D2 measured from the front flat surface 132 of the second lifter attachment portion 118 to a distal end 158 of the second bumper 154 in the front-facing direction F. The first depth D1 is greater than the second depth D2. The first depth D1 is defined such that the first bumper 152 extends beyond the distal edge 128 of the flange 124 as described. As a non-limiting example, the first depth D1 can be approximately 5 mm, with approximately 1.0 mm-1.5 mm of the first depth D1 extending beyond the distal edge 128 of the flange 124. The second depth D2 can be, as a non-limiting example, about 2.0 mm. The second depth D2 only needs to prevent the window from contacting the second lifter attachment portion 118 as the window is moved vertically into the shipping position. The second bumper 154 is required because as the window 26 comes in contact with the first bumper 152, the force will rotate the window regulator 100 around the guide rail 40 in the direction of arrow A in FIG. 8. This rotation of the window regulator 100 rotates the second lifter attachment portion 118 in the opposite direction and can be enough to move the second lifter attachment portion 118 to contact the window 26. To prevent scratching the window 26 with the second lifter adjustment portion 118, a shallow second bumper 154 is used. As illustrated in FIG. 8, as the window 26 is moved vertically in the window channels 28 up the door 20 (illustrated in FIGS. 2A and 2B) and over the window regulator 100, the window 26 contacts the first and second bumpers 152, 154, easily moving over the injection-molded plastic, which does not scratch the window 26 as the metal of the flange 124 and the second lifter attachment portion 118 does.

As seen in FIG. 6, the window lifter 30, whether in two pieces or another configuration, attaches flush to each of the flat surfaces 130, 132 of the first and second lifter attachment portions 116, 118, taking up a majority of the surface area of the flat surfaces 130, 132. The first and second bumpers 152, 154 are configured on the respective flat surfaces 130, 132 so that positioning the window lifter 30 on the first and second lifter attachment portions 116, 118 is not obstructed. The positioning of the first bumper 152 is further constrained by the flange 124. A longitudinal end 134 of the flange 124 is proximate the first lifter attachment portion 116, extending along an edge of the first lifter attachment portion 116, as shown in FIG. 6. The first bumper 152 is positioned on the front flat surface 130 of the first lifter attachment portion 116 between the longitudinal end 134 of the flange 124 and the lifter aperture 122, and spaced from the lifter aperture 122 so that the first bumper 152 does not obstruct insertion of the window lifter 30. Due to the space constraints on the flat surface 130 of the first lifter attachment portion 116, the first bumper 152 has an asymmetrical shape configured to fit between the flange 124 and the window lifter 30 when the window lifter 30 is positioned within the lifter aperture 122 of the first lifter attachment portion 116. The shape is not limited to the shape illustrated in FIGS. 4 and 6. The second bumper 154 is also constrained by the window lifter 30 when it is positioned within the lifter aperture 122 of the second lifter portion 118. The second bumper 154 is not limited to the symmetrical shape illustrated in FIGS. 4 and 6 and can be any symmetrical or asymmetrical shape so long as the window lifter 30 is not obstructed.

Figure 9:
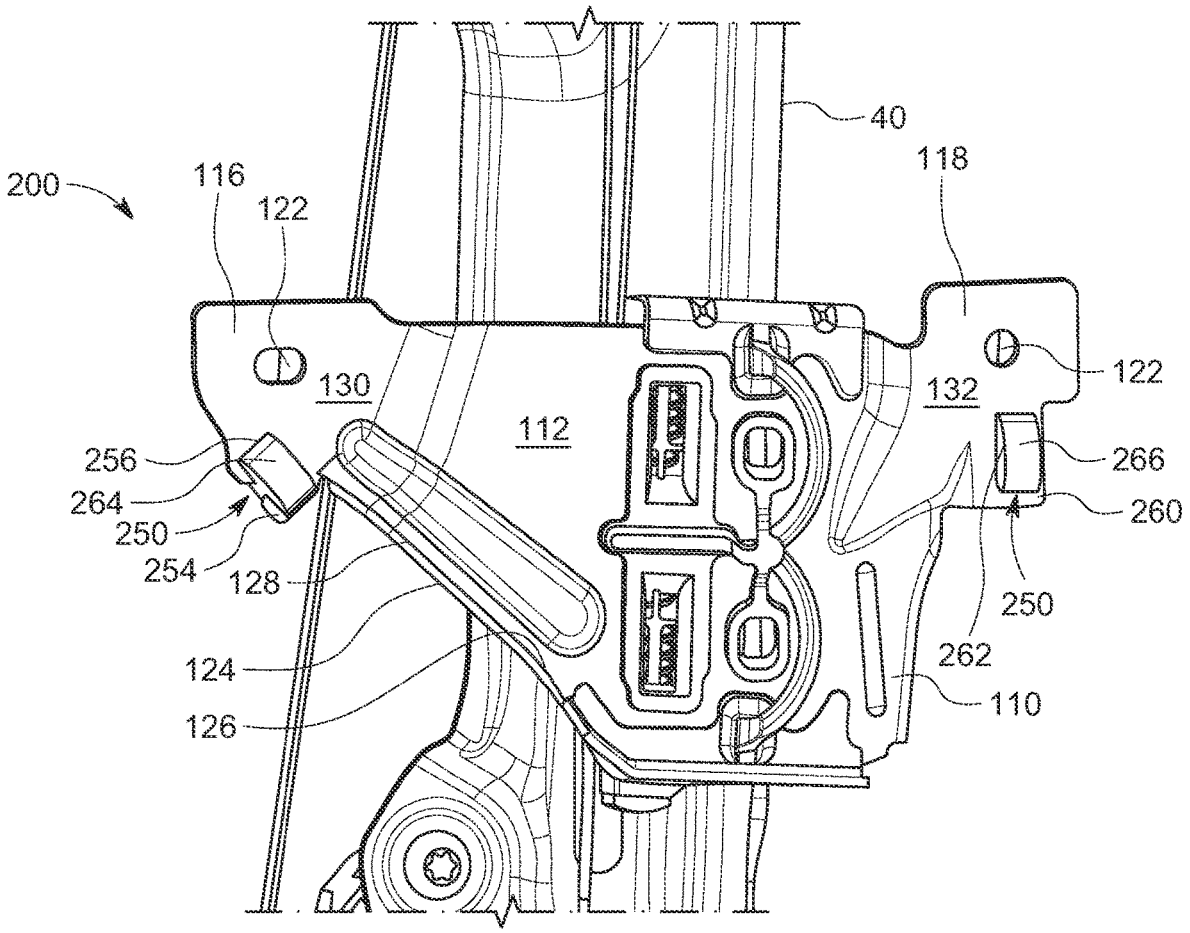
FIG. 9 is a front elevation view of another implementation of a window regulator attached to a guide rail as disclosed herein.
Figure 10:
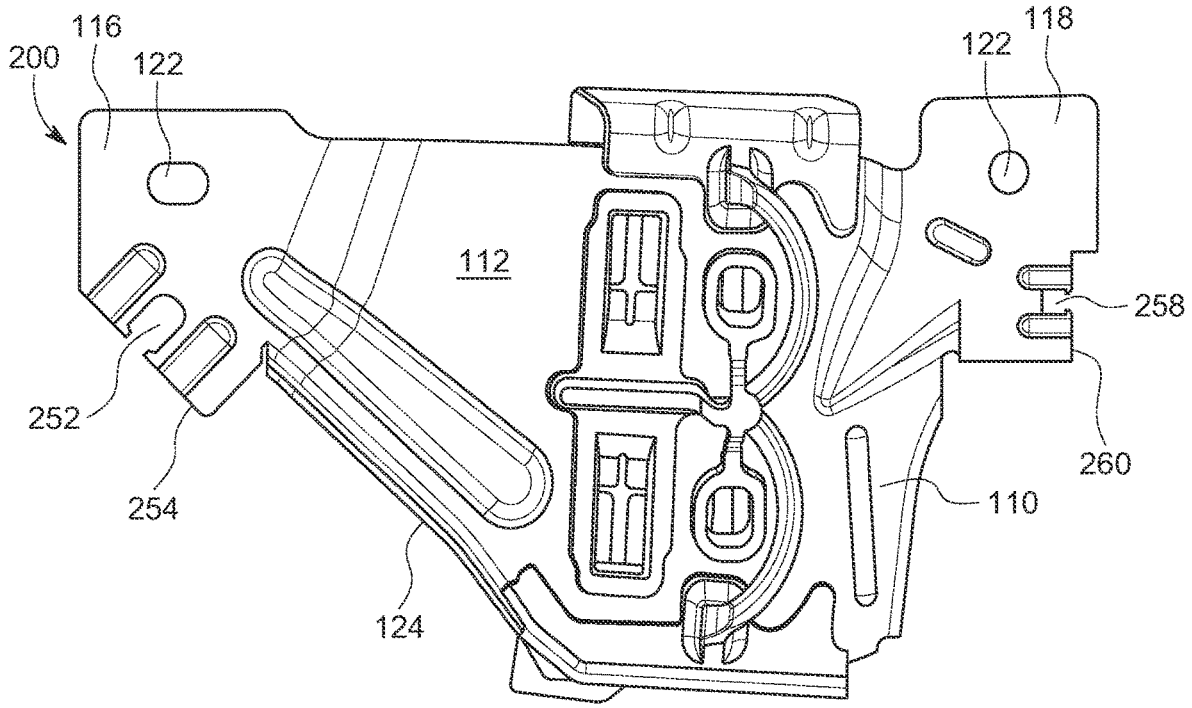
FIG. 10 is front elevation view of the window regulator of FIG. 9 without the first and second bumpers.

FIGS. 9 and 10 shows another implementation of a window regulator as disclosed herein. As with the window regulator 100 of FIG. 4, the window regulator 200 of FIG. 9 also has a carrier plate 110 having a front surface 112 and a rear surface 114, the carrier plate 110 configured to be attached to a guide rail 40 with the rear surface 114 facing the guide rail 40. A first lifter attachment portion 116 is spaced from a second lifter attachment portion 118 and both are integral with the carrier plate 110 as described with respect to window regulator 100. Each of the first and second lifter attachment portions 116, 118 has a lifter aperture 122 configured to receive a window lifter 30, which can be configured as described with respect to FIG. 4.

The window regulator 200 further has a flange 124 extending at an angle along a length of an edge 126 of the front surface 112 of the carrier plate 110. The flange 124 extends outwards in a front-facing direction F, illustrated in FIG. 7, which is from the inner door panel 42 to the outer door panel (not shown). The flange 124, or a portion thereof, is the part of the carrier plate 110 that extends furthest in the front-facing direction F and limits the clearance C between the carrier plate 110 and the frame support 34A described with respect to FIG. 3.

The window regulator 200 further has a window protection system 250 illustrated in FIGS. 9 and 10, proximate to the first lifter attachment portion 116 and the second lifter attachment portion 118. At least a part of the window protection system 250 is configured to extend beyond a distal edge 128 of the flange 124 in the front-facing direction F. Window protection system 250 comprises a first bumper receiver 252 formed in an edge 254 of the first lifter attachment portion 116 and configured to receive and hold a first bumper 256, and a second bumper receiver 258 formed in an edge 260 of the second lifter attachment portion 118 and configured to receive and hold a second bumper 262. The first bumper receiver 252 and the second bumper receiver 258 are best seen in FIG. 10. The first and second bumpers 256, 262 are fitted into the respective first and second bumper receivers 252, 258. The first and second bumper receivers 252, 258 are sized to tightly receive a rear projection of the first and second bumpers 256, 262, which can have a narrower profile than a front-facing portion of the first and second bumpers 256, 262. The first bumper 256 and the second bumper 262 can be plastic or rubber.

The first bumper 256 extends beyond the distal edge 128 of the flange 124, as illustrated with respect to the first implementation in FIGS. 7 and 8, in the front-facing direction F. In such a configuration, the first bumper 256 is positioned to contact the window 26 as the window 26 is installed along the window channels 28 between the window regulator 200 and the door frame supports 34A, 34B. The first bumper 256 will not scratch the window 26 when in contact with the window 26.

The first bumper 256 has a first depth D1 measured from the front flat surface 130 of the first lifter attachment portion 116 to a distal end 264 of the first bumper 256 in the front-facing direction F, illustrated with respect to the first implementation in FIGS. 7 and 8. The second bumper 262 has a second depth D2 measured from the front flat surface 132 of the second lifter attachment portion 118 to a distal end 266 of the second bumper 262 in the front-facing direction F. The first depth D1 can be greater than the second depth D2. The first depth D1 is defined such that the first bumper 256 extends beyond the distal edge 128 of the flange 124 as described. The second depth D2 only needs to prevent the window from contacting the second lifter attachment portion 118 as the window is moved vertically into the shipping position. Alternatively, first depth D1 and second depth D2 can be equal.

As seen in FIG. 6, the window lifter 30, whether in two pieces or another configuration, attaches flush to each of the flat surfaces 130, 132 of the first and second lifter attachment portions 116, 118, taking up a majority of the surface area of the flat surfaces 130, 132. The first and second bumpers 256, 262 are configured on the respective flat surfaces 130, 132 so that positioning the window lifter 30 on the first and second lifter attachment portions 116, 118 is not obstructed. The first and second bumpers 256, 262 can be shaped as illustrated in FIG. 9, or can be another shape, so long as the window lifter 130 is not obstructed.

Figure 11:
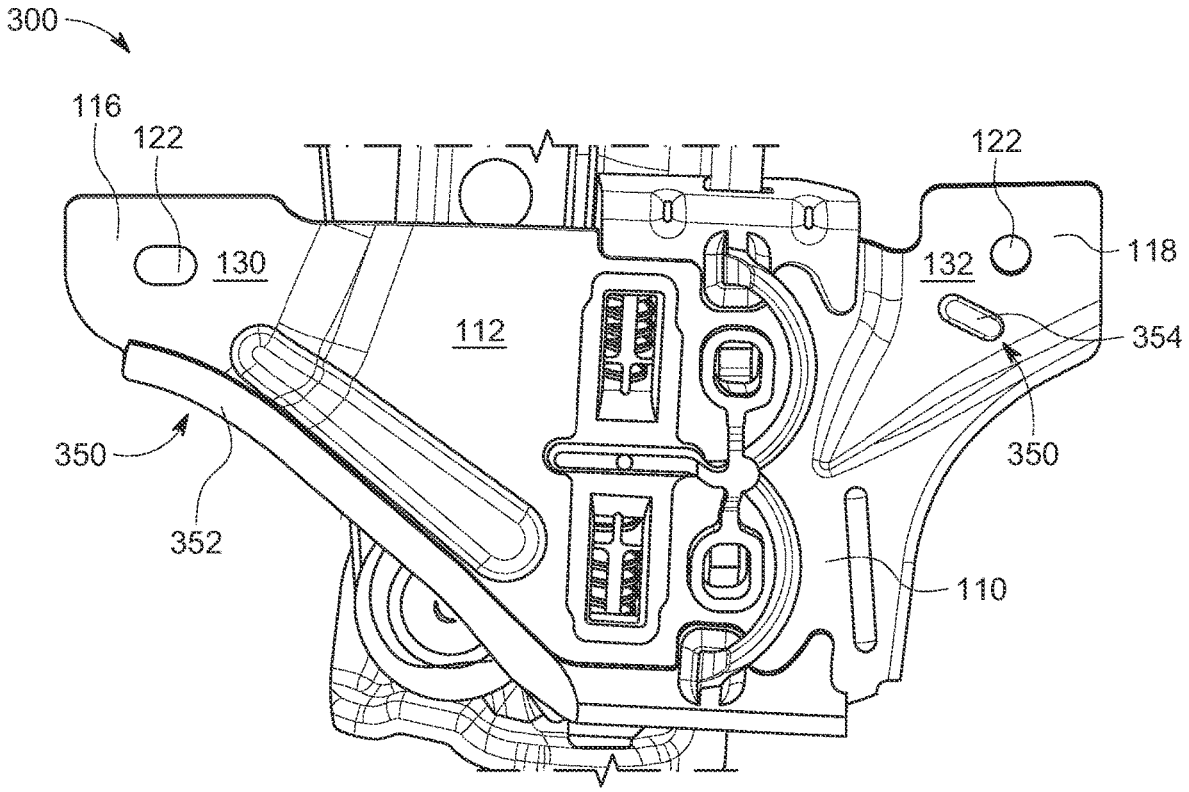
FIG. 11 is a front elevation view of yet another implementation of a window regulator attached to a guide rail as disclosed herein.

FIG. 11 shows another implementation of a window regulator as disclosed herein. As with the window regulators 100, 200 of FIGS. 4 and 9, the window regulator 300 of FIG. 11 also has a carrier plate 110 having a front surface 112 and a rear surface 114, the carrier plate 110 configured to be attached to a guide rail 40 with the rear surface 114 facing the guide rail 40. A first lifter attachment portion 116 is spaced from a second lifter attachment portion 118 and both are integral with the carrier plate 110 as described with respect to window regulator 100. Each of the first and second lifter attachment portions 116, 118 has a lifter aperture 122 configured to receive a window lifter 30, which can be configured as described with respect to FIG. 4.

The window regulator 300 further has a flange 124 extending at an angle along a length of an edge 126 of the front surface 112 of the carrier plate 110. The flange 124 extends outwards in a front-facing direction F, illustrated in FIG. 7, which is from the inner door panel 42 to the outer door panel (not shown). The flange 124, or a portion thereof, is the part of the carrier plate 110 that extends furthest in the front-facing direction F and limits the clearance C between the carrier plate 110 and the frame support 34A described with respect to FIG. 3.

The window regulator 300 further has a window protection system 350 illustrated in FIG. 11, proximate to the first lifter attachment portion 116 and the second lifter attachment portion 118. At least a part of the window protection system 350 is configured to extend beyond a distal edge 128 of the flange 124 in the front-facing direction F. Window protection system 350 comprises a flange cover 352 covering at least a longitudinal portion of the flange 124 proximate the first lifter attachment portion 116 and a bumper 354 extending from the front flat surface 132 of the second lifter attachment portion 118. The flange cover 352 can cover an entire length of the flange 124 as illustrated in FIG. 11. The flange cover 352 and the bumper 354 can be plastic. The bumper 354 can be injection molded or can be a bumper received in a bumper receiver as described with respect to second bumper 262 of the second implementation.

Because the flange cover 352 covers the flange 124, the flange cover 352 extends beyond the distal edge 128 of the flange 124 in the front-facing direction F. In such a configuration, the flange cover 352 is positioned to contact the window 26 as the window 26 is installed along the window channels 28 between the window regulator 200 and the door frame supports 34A, 34B. The flange cover 352 will not scratch the window 26 when in contact with the window 26.

The bumper 354 prevents the window from contacting the second lifter attachment portion 118 as the window is moved vertically into the shipping position. The bumper 354 is required because as the window 26 comes in contact with the flange cover 352, the force will rotate the window regulator 100 around the guide rail 40 in the direction of arrow A in FIG. 8. This rotation of the window regulator 300 rotates the second lifter attachment portion 118 in the opposite direction and can be sufficient to move the second lifter attachment portion 118 to contact the window 26. To prevent scratching the window 26 with the second lifter adjustment portion 118, a shallow bumper 354 is used. As illustrated in FIG. 8, as the window 26 is moved vertically in the window channels 28 up the door 20 (illustrated in FIGS. 2A and 2B) and over the window regulator 300, the window 26 contacts the flange cover 352 and the bumper 354, easily moving over them, which does not scratch the window 26 as the metal of the flange 124 and the second lifter attachment portion 118 does.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A window regulator for a vehicle door window, the window regulator comprising:

a carrier plate having a front surface and a rear surface, the carrier plate configured to be attached to a guide rail with the rear surface facing the guide rail;

a first lifter attachment portion spaced from a second lifter attachment portion, the first lifter attachment portion and the second lifter attachment portion integral with the carrier plate and each having a lifter aperture configured to receive a window lifter;

a flange extending at an angle along a length of an edge of the front surface of the carrier plate; and a window protection system proximate to the first lifter attachment portion and the second lifter attachment portion, at least a part of which is configured to extend beyond a distal edge of the flange in a front-facing direction.

2. The window regulator of claim 1, wherein the window protection system comprises:

a first bumper extending from a front flat surface of the first lifter attachment portion; and a second bumper extending from a front flat surface of the second lifter attachment portion, wherein the first bumper extends beyond the distal edge of the flange.

3. The window regulator of claim 2, wherein the first bumper has a first depth measured from the front flat surface of the first lifter attachment portion to a distal end of the first bumper in the front-facing direction, and the second bumper has a second depth measured from the front flat surface of the second lifter attachment portion to a distal end of the second bumper in the front-facing direction, the first depth being greater than the second depth.

4. The window regulator of claim 2, wherein a longitudinal end of the flange is proximate the first lifter attachment portion, and the first bumper is positioned on the front flat surface of the first lifter attachment portion between the longitudinal end of the flange and the lifter aperture.

5. The window regulator of claim 2, wherein the first bumper and the second bumper are injection molded plastic, each molded in a bumper aperture in each of the first lifter attachment portion and the second lifter attachment portion.

6. The window regulator of claim 2, wherein the window protection system further comprises:

a first bumper receiver formed in an edge of the first lifter attachment portion and configured to receive and hold the first bumper; and a second bumper receiver formed in an edge of the second lifter attachment portion and configured to receive and hold the second bumper.

7. The window regulator of claim 6, wherein the first bumper and the second bumper are plastic or rubber.

8. The window regulator of claim 1, wherein the window protection system comprises:

a flange cover covering at least a longitudinal portion of the flange proximate the first lifter attachment portion; and a bumper extending from a front flat surface of the second lifter attachment portion.

9. The window regulator of claim 8, wherein the flange cover covers an entire length of the flange.

10. A window regulator for a vehicle door window, the window regulator comprising:

a carrier plate having a front surface and a rear surface, the carrier plate configured to be attached to a guide rail with the rear surface facing the guide rail;

a first lifter attachment portion spaced from a second lifter attachment portion, the first lifter attachment portion and the second lifter attachment portion integral with the carrier plate and each having a lifter aperture configured to receive a window lifter;

a flange extending at an angle along a length of an edge of the front surface of the carrier plate, the flange having a distal edge;

a first bumper extending from a front flat surface of the first lifter attachment portion; and a second bumper extending from a front flat surface of the second lifter attachment portion, wherein the first bumper extends beyond the distal edge of the flange.

11. The window regulator of claim 10, wherein the first bumper has a first depth measured from the front flat surface of the first lifter attachment portion to a distal end of the first bumper in a front-facing direction, and the second bumper has a second depth measured from the front flat surface of the second lifter attachment portion to a distal end of the second bumper in the front-facing direction, the first depth being greater than the second depth.

12. The window regulator of claim 10, wherein the flange further extends along an edge of the first lifter attachment portion, and the first bumper is positioned on the front flat surface of the first lifter attachment portion adjacent the flange.

13. The window regulator of claim 12, wherein the first bumper has an asymmetrical shape configured to fit between the flange and the window lifter when the window lifter is positioned within the lifter aperture of the first lifter attachment portion.

14. The window regulator of claim 10, wherein the first bumper and the second bumper are injection molded plastic, each molded in a bumper aperture in each of the first lifter attachment portion and the second lifter attachment portion.

15. The window regulator of claim 10, further comprising:

a first bumper receiver formed in an edge of the first lifter attachment portion and configured to receive and hold the first bumper; and a second bumper receiver formed in an edge of the second lifter attachment portion and configured to receive and hold the second bumper.

16. The window regulator of claim 15, wherein the first bumper and the second bumper are plastic or rubber.

17. A vehicle door, comprising:

a window regulator having a first surface and a second surface opposite the first surface; and a guide rail, wherein the window regulator is movably attached to the guide rail with the second surface facing the guide rail, the window regulator configured to attach to a window and move the window via movement of the window regulator along the guide rail, the window regulator comprising:

a first lifter attachment portion spaced from a second lifter attachment portion, the first lifter attachment portion and the second lifter attachment portion each having a lifter aperture configured to receive a window lifter;

a flange extending at an angle along an edge of the window regulator in a direction opposite the guide rail; and a window protection system proximate to the first lifter attachment portion and the second lifter attachment portion, at least a part of which is configured to extend beyond a distal edge of the flange in the direction opposite the guide rail.

18. The vehicle door of claim 17, wherein the window protection system comprises:

a first bumper extending from a front flat surface of the first lifter attachment portion; and a second bumper extending from a front flat surface of the second lifter attachment portion, wherein the first bumper extends beyond the distal edge of the flange.

19. The vehicle door of claim 18, wherein the first bumper has a first depth measured from the front flat surface of the first lifter attachment portion to a distal end of the first bumper in the direction opposite the guide rail, and the second bumper has a second depth measured from the front flat surface of the second lifter attachment portion to a distal end of the second bumper in the direction opposite the guide rail, the first depth being greater than the second depth.

20. The vehicle door of claim 17, wherein the window protection system comprises:

a flange cover covering the flange; and a bumper extending from a front flat surface of the second lifter attachment portion.

* * * * *